US005995455A

United States Patent [19]

Kutosky

[11] Patent Number: 5,995,455

[45] Date of Patent: Nov. 30, 1999

[54] ALARM TIMER DEVICE

[76] Inventor: Thomas H. Kutosky, Ten Barrington Dr., Pittsburgh, Pa. 15209

[21] Appl. No.: 09/016,020

[22] Filed: Jan. 30, 1998

[51] Int. Cl.[6] ..... G04B 23/02; G04B 23/00; G04C 21/00

[52] U.S. Cl. ..... 368/73; 368/263

[58] Field of Search ..... 368/72–74, 250, 368/251, 262–263

[56] References Cited

U.S. PATENT DOCUMENTS

| | | | |
|---|---|---|---|
| 4,228,645 | 10/1980 | Nomura | 368/75 |
| 5,379,273 | 1/1995 | Horinec | 368/73 |
| 5,442,600 | 8/1995 | Kutosky | 368/109 |
| 5,559,495 | 9/1996 | Cochran | 340/457 |

*Primary Examiner*—Vit Miska
*Attorney, Agent, or Firm*—Bartony & Hare

[57] ABSTRACT

An alarm clock comprises circuitry for a primary alarm that causes an alarm to sound at a preset time of day and a secondary alarm which causes the alarm sound after countdown of a secondary alarm time period. The alarm clock includes a secondary alarm switch, a central processing unit and a memory electrically connected to the central processing unit and the secondary alarm switch. The memory contains a program which enables a user to set the alarm to activate at the end of the secondary alarm time period. The program preferably further provides that the secondary alarm period can also be set independent of whether the alarm has sounded at the primary alarm time or whether the primary alarm on/off switch is in an on or an off state. The program also preferably causes the secondary alarm time period to be displayed on the display unit. Also, an alarm clock comprises an alarm discontinue switch operable to discontinue activation of the alarm after the primary alarm time without changing the state of the primary alarm on/off switch to an off state.

17 Claims, 4 Drawing Sheets

ALARM TIMER DEVICE

FIELD OF THE INVENTION

The present invention relates to a timer device, and, in particular, to a timer device for use in an alarm clock having a secondary alarm feature and to an alarm clock having an alarm stop or discontinue feature.

BACKGROUND OF THE INVENTION

Various alarm clocks include a snooze feature that enables a person to return to sleep after an initial or primary alarm (that is, an alarm set to sound at a specified time of day, for example, 6:15 AM) has sounded and be awakened a predetermined amount of time after activation of the snooze time, typically nine minutes after such activation. In the case of most alarms with a snooze feature, if the person would like to sleep for a longer period than the preset snooze time, he or she must reset or reactivate the snooze feature each time the predetermined time has elapsed and the alarm sounds. For instance, if such an alarm clock has a predetermined snooze time of nine minutes, for the person to sleep 27 minutes beyond the sounding of the primary alarm, the person must first activate the snooze button after the primary alarm initially sounds and then be awakened twice (by the sounding of the alarm at 9 and 18 minutes) to reactivate the snooze feature.

U.S. Pat. No. 5,442,600, the disclosure of which is incorporated herein by reference, discloses an improved snooze-timer device that provides an uninterrupted snooze time interval selected by the user. After sounding of the primary alarm, the snooze time interval can be selected by the user by repeatedly depressing a snooze button to increase the snooze time by a predetermined interval. For example, with a predetermined interval of five minutes, the user simply presses the snooze button six times after the initial or primary alarm sounds to program a snooze time of thirty uninterrupted minutes. The snooze time interval can be reset to zero during countdown thereof by pressing and holding the snooze button for two seconds. An alarm sounding after the countdown of the snooze time interval can be stopped by either pressing and holding the snooze button for two seconds or by turning the primary alarm on/off switch to the off state.

Although the snooze-timer device of U.S. Pat. No. 5,442,600 is a substantial improvement over the prior art, it remains very desirable to develop alarm devices incorporating improved features, and, particularly, improved snooze features.

SUMMARY OF THE INVENTION

The present invention provides an alarm clock of the type being connectable to a power source (that is, either an AC or DC power source). The alarm clock comprises:

a) a clock;

b) a display;

c) an alarm;

d) primary alarm circuitry in communication with the clock, the display and the alarm, the primary alarm circuitry including a primary alarm on/off switch and at least one input control for setting a primary alarm time corresponding to a predetermined time of day, the alarm being activated at the primary alarm time when the primary alarm on/off switch is in an on state;

e) a secondary alarm input control;

f) a central processing unit electrically connected to the display, the secondary alarm input control, the alarm and the clock; and g) a memory electrically connected to the central processing unit.

The memory contains a program which enables a user to set the alarm to activate at the end of a countdown of a secondary alarm time period selected by the user via the secondary alarm input control. The program in the memory further provides that, upon a sounding of the alarm at the primary alarm time, activation of the secondary alarm input control stops sounding of the alarm and sets the secondary alarm time period to the secondary alarm time period selected by the user. The program in memory further provides that the secondary alarm time period can also be set independent of whether the alarm has sounded at the primary alarm time or whether the primary alarm on/off switch is in an on or off state.

The secondary alarm input control can be any type of input control enabling the user to select a secondary alarm time period. For example, a slidable or rotatable control knob can be used. Also, a combination control such as rotatable knob/contact switch can be used. Preferably, the secondary alarm input control is a secondary alarm switch, and the selection of the secondary alarm time period is made by activating the secondary alarm switch for a first period of time a number of times. Each activation of the secondary alarm switch for the first period of time increases the secondary alarm time period by a predetermined interval of time. The program preferably further provides that, upon a sounding of the alarm at the primary alarm time, activation of the secondary alarm switch for the first period of time stops sounding of the alarm and sets the secondary alarm time period to the predetermined interval of time. Subsequent activations of the secondary alarm switch increase the secondary alarm time period by the predetermined interval for each such activation. The program also preferably causes the secondary alarm time period to be displayed on the display unit.

Like prior alarms with a snooze timer feature, the secondary alarm of the present invention can be set to extend a period of sleep after the sounding of the alarm at the primary alarm time. Unlike prior alarms with a snooze timer feature, however, the programming of the alarm clock of the present invention may be activated at any time, regardless of the state of the primary alarm. In that regard, the operation of the secondary alarm is independent of whether the primary alarm has sounded or even whether the primary alarm switch is in the on or off position or state. In prior alarm clocks with a snooze timer feature, the snooze timer feature can be activated only when the primary alarm switch is the on state and after the primary alarm has sounded. Moreover, the alarm clock of the present invention allows the user to choose the duration of the secondary alarm time period. Furthermore, the user of the present invention has the ability to change the secondary alarm time period at any time during the countdown thereof by, for example, resetting the secondary alarm time period to zero or adding additional time. The user is also not limited in the number of times such changes can be made.

The program in the memory of the alarm clock of the present invention preferably further provides that activation (for example, depression of a button-type switch) of the secondary alarm switch once for a second length of time after a secondary alarm time period has been set will reset secondary alarm time period to zero. The program in memory preferably also provides for a time period following the last depression of the secondary alarm switch for the first period of time and preceding the depression of the secondary alarm switch for the second period of time during which depression of the secondary alarm switch will have no effect, so that the secondary alarm time period is not inadvertently reset to zero.

The program in the memory preferably further provides that the time remaining in the secondary alarm time during a countdown thereof can be increased by depression of the secondary alarm switch for the first period of time one or more times at any time during the countdown of the secondary alarm time.

The alarm clock preferably further comprises a housing to which the display is attached. The clock, the alarm, the memory, and the central processing unit are preferably enclosed within the housing. The secondary alarm switch is attached to the housing in a manner to make it easily locatable by a user of the alarm clock. In that regard, the secondary alarm switch is preferably separated from other switches attached to the housing. Typically, the housing for the alarm clock of the present invention will have at least two distinguishable surfaces (for example, a housing for a pyramidal alarm clock has four surfaces, while a housing for a cube-shaped alarm clock has six surfaces). Preferably, the secondary alarm switch is the only input control or the only switch attached to one of the surfaces of the housing.

Preferably a single display is provided, and that display alternates between displaying the time of day and the time remaining in the secondary alarm time period when a secondary alarm time period has been set. The use of a single display to set forth multiple types of information to the user reduces complexity and manufacturing costs as compared to the use of multiple displays.

The alarm clock of the present invention can be used in any case in which it is desirable to measure a period without repeated resetting of the primary alarm time of an alarm clock. Particularly, the secondary alarm or snooze-timer of the present invention may be used as a timer for naps or reminders. Moreover, the present invention provides an alarm clock in which substantially all of the functions of the alarm and the secondary alarm time period are controlled using a single, easily locatable secondary alarm input control. The provision of a single, easily locatable secondary alarm input control for controlling these functions is especially desirable in that the user must often exercise such control in a semi-conscious state.

The present invention also provides an electronic alarm clock comprising:

a) a clock;

b) a display;

c) an alarm;

d) a primary alarm on/off switch, the alarm being activated at the primary alarm time when the primary alarm on/off switch is in an on state;

e) at least one input control for setting a primary alarm time corresponding to a predetermined time of day; and f) an alarm discontinue switch, the alarm discontinue switch being operable to discontinue activation of the alarm after the primary alarm time without changing the state of the primary alarm on/off switch to an off state.

Allowing a primary alarm to be shut off after activation/sounding without the requirement of turning the primary alarm on/off switch to the "off" position/state, allows the user to set a primary alarm time at which the primary alarm will sound each day without the risk of forgetting to turn primary alarm on/off switch to the "on" position/state every day. In other words, the primary alarm time will remain set/on and will sound every 24 hours at the set time. Preferably, the alarm discontinuance switch is the only control on the alarm clock allowing manual shut-off of the alarm.

Preferably, the primary alarm discontinue switch includes circuitry to prevent accidental discontinuance of activation (for example, sounding) of the alarm. This circuitry preferably requires a positive action or command by the user of the alarm clock that is indicative of a fully conscious state of the user. For example, the primary alarm discontinue switch may be a button-type switch that must be pressed and held for a predefined period of time to discontinue activation/sounding of the preset alarm. Preferably, the predefined period of time is approximately two seconds or more to help prevent accidental discontinuance of the alarm.

In a preferred embodiment, a secondary alarm input control as described above and the primary alarm discontinuance switch are the same. For example, the programming of the memory discussed above in connection with the secondary alarm time preferably provides that activation/depression of the secondary alarm switch once for a third length of time causes an alarm activated/sounded by a setting of the primary alarm or the secondary alarm to be discontinued without setting a secondary alarm time period.

Preferably, the first length of time for activation of the secondary alarm switch to incrementally increase the length of the secondary alarm time is rather short, for example, less than two seconds. The second and third lengths of time for depression of the secondary alarm switch are preferably longer than the first length of time, for example, two seconds or greater. In a preferred embodiment, the second and third lengths of time for activation of the secondary alarm switch are both at least two seconds. In other words, in the case of a button-type switch, if the button is depressed and released quickly (less that two seconds) the secondary alarm time will be initiated or incrementally increased. If a secondary alarm time has been previously set and the secondary alarm switch is depressed and held for two seconds or longer (that is, for the second length of time), the secondary alarm time will be reset to zero. If an alarm corresponding to a primary alarm or a secondary alarm is activated/sounding and the secondary alarm switch is depressed and held for two seconds or longer (the third length of time) the alarm will be discontinued and no secondary alarm time will be set. If an alarm corresponding to a primary alarm is activated/sounding and the secondary alarm switch is depressed for less than two seconds (the first length of time) the alarm will be discontinued and the secondary alarm time period will be set to the predetermined interval of time. Subsequent activations/depressions of the secondary alarm switch in the last case for the first period of time will increase the secondary alarm time period by the predetermined interval of time each time the secondary alarm switch is activated.

As discussed above, the user can set a secondary alarm time period at any time, even if, for example, a primary alarm time has been set but no alarm has yet sounded, or the primary alarm on/off control or switch is in an off state

DETAILED DESCRIPTION OF THE INVENTION

Figure 1:
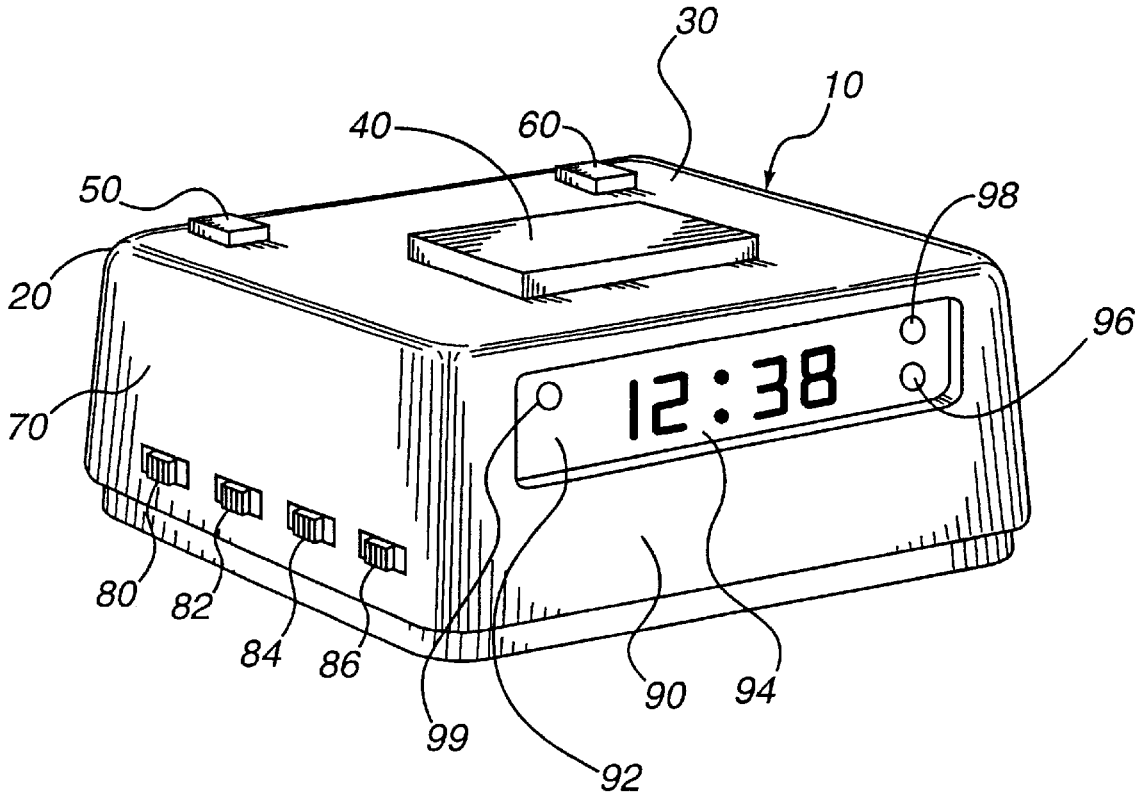
FIG. 1 illustrates an embodiment of an alarm clock of the present invention.

FIG. 1 illustrates an embodiment of the present invention in which a secondary alarm or snooze-timer is incorporated in an alarm clock 10. Alarm clock 10 preferably comprises a housing with a top surface 30. Top surface 30 of housing 20 may, for example, include three input controls 40, 50 and 60. A side surface 70 of housing 20 may include, for example, an alarm on/off slide switch 80, a radio/buzzer alarm selection slide switch 82, a brightness selection slide switch 84 and a real time/real time setting/alarm time setting slide switch 86, as known in the art. At least two brightness settings as controlled by slide switch 84 are preferably provided.

Figure 2:
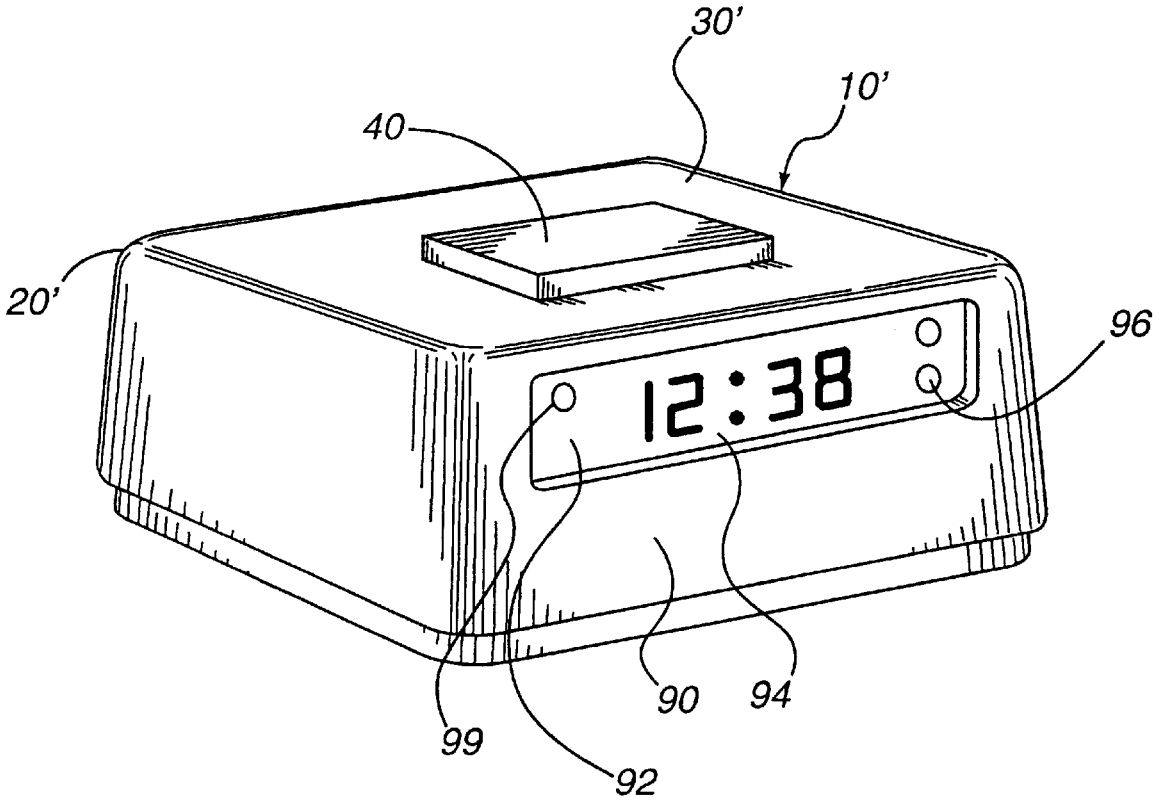
FIG. 2 illustrates another embodiment of an alarm clock of the present invention having a single button-type switch on one surface of the housing corresponding to the secondary alarm switch.
Figure 3:
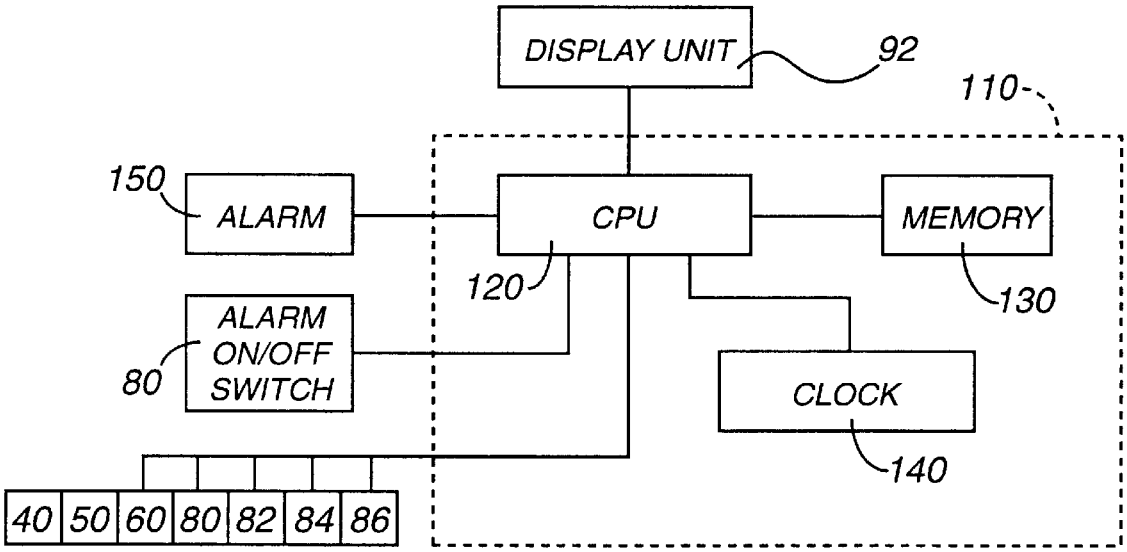
FIG. 3 illustrates a block diagram of the basic electronic components of the present invention.

Preferably, input control 40, 50 and 60 are button-type switches. Control switches or buttons 40, 50 and 60 are preferably labeled, "snooze", "hour", and "minute", respectively. Secondary alarm switch 40 is preferably substantially larger than the other buttons such that secondary alarm switch 40 is easily identified and contacted. FIG. 2 illustrates another preferred embodiment of an alarm clock 10' of the present invention in which secondary alarm switch 40 is enlarged and is the only switch placed on a top surface 30' of housing 20'. In the embodiment of FIG. 2, other switches (for example, corresponding to those represented in FIG. 1) are preferably placed on the rear surface (not shown) of housing 20'. Secondary alarm switch 40 is particularly identifiable and easy to contact in the embodiment of FIG. 2.

Hour button 50 and minute button 60 are preferably used to program the time of day and primary alarm time as known in the art. As used herein, the term "primary alarm time" refers to a time of day selected by the use of alarm clock 10 at which an alarm will activate (typically, sound) if switch 80 is in the "on" position. Secondary alarm switch 40 is used to program the secondary alarm of the present invention as described below.

As clear to one skilled in the art, secondary alarm switch 40, hour button 50, minute button 60, slide switches 80, 82, 84 and 86 can take forms other than buttons and slide switches as known in the art. Slide switches can, for example, be replaced by turn dials. For ease of use, however, snooze input control 40, hour switch 50, and minute switch 60 preferably comprise switches activated by touch such as a button switch or touch pad.

Housings 20 and 20' further include a front surface 90 having at least one display window 92, which is preferably a liquid crystal display (LCD) as known in the art. Other types of displays, such as, for example, a light emitting diode (LED) display, can also be used. Display window 92 preferably includes at least a four digit read out 94 and a battery low indicator 96.

Figure 4:
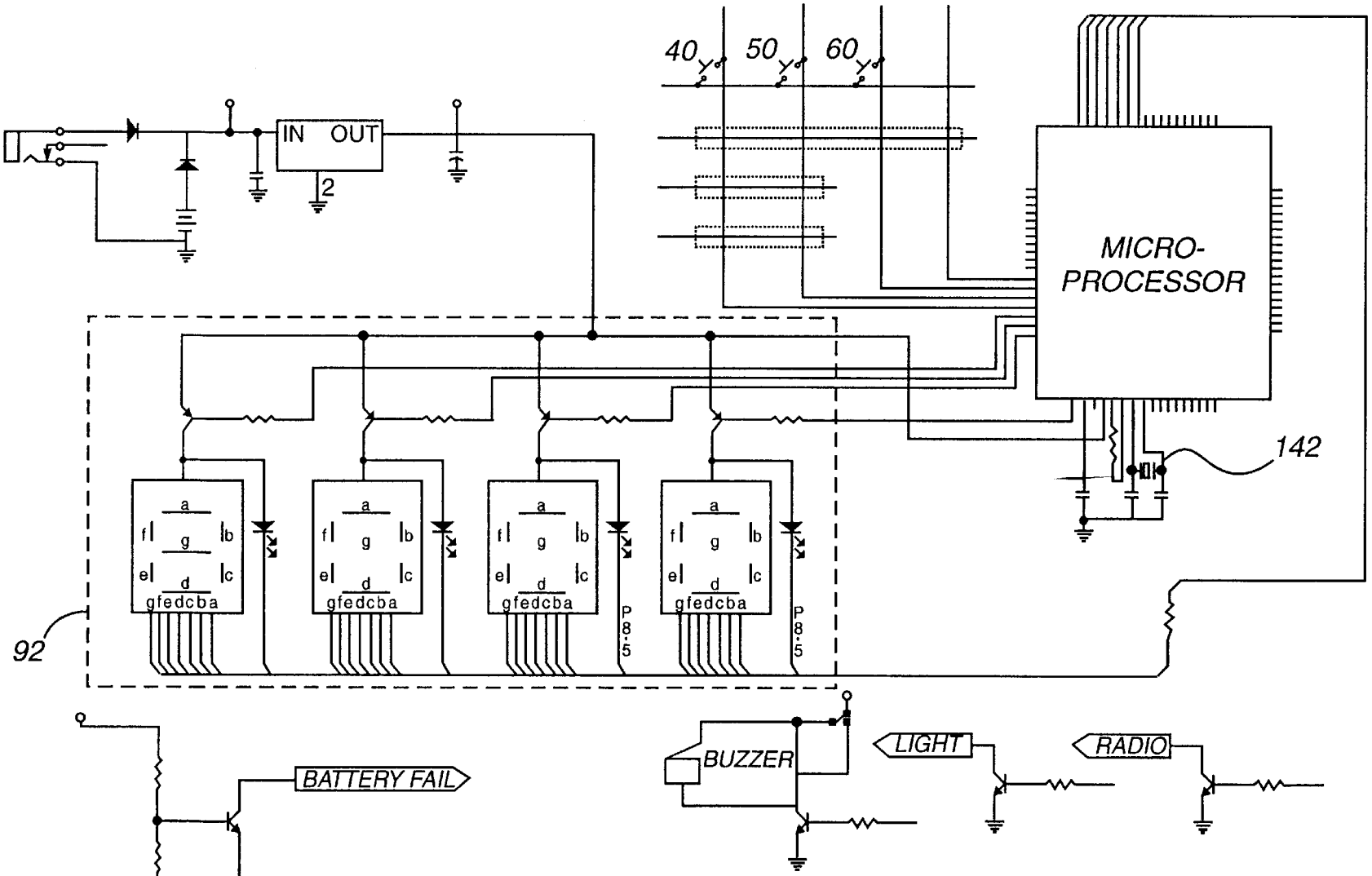
FIG. 4 illustrates a circuit diagram of one embodiment of the present invention.

Housing 20 preferably encases the conventional contents/circuitry of an alarm clock as known in the art as well as a microprocessor chip 110. Referring to FIG. 2, microprocessor chip 110 preferably comprises a central processing unit 120, a memory 130, and a clock 140 comprising, for example, a 32.768 kHz crystal oscillator 142. An alarm 150, switches 80, 82, 84 and 86 and input control buttons 40, 50 and 60 are in communicative connection to central processing unit 120 which controls the display unit 90. An example of a circuit diagram for this embodiment is illustrated in FIG. 4.

Memory 130 preferably contains a program which enables the secondary alarm to work in the following manner. At the initial depression of secondary alarm switch 40, display window 90 is illuminated such that the secondary alarm time period is displayed. Upon a first depression of secondary alarm switch 40, display window 90 preferably indicates clock 140 being set to a predetermined increment of time, preferably "5" (5 minutes). When secondary alarm switch 40 is depressed a second time, the secondary alarm time period preferably advances in the predetermined increment (a five minute increment in this embodiment), thus displaying "10" (ten minutes) on display window 90. Secondary alarm switch 40 can be depressed consecutively a number of times to select a secondary alarm time period up to preferably at least 90 minutes (in five minute increments, for instance, 5, 10, 15, 20 . . . 80, 85, and 90 minutes). In setting the secondary alarm time period, secondary alarm switch 40 is preferably activated, for example, pressed, and released after a relatively short period of time (for example, less than two seconds) to incrementally increase the secondary alarm time period. After preferably five seconds have elapsed after a depression of secondary alarm switch 40 to incrementally increase the secondary alarm time period, the countdown of the secondary alarm time period preferably commences. The countdown can be indicated by flashing a snooze-countdown indicator 98.

At any time during the countdown, secondary alarm switch 40 can preferably be contacted or depressed one or more times to increase the time remaining in the snooze interval in five minute increments. For example, if 13 minutes were remaining in the secondary alarm time period and the user depressed secondary alarm switch 40, the countdown would stop and the secondary alarm time period would preferably be increased to the nearest higher time which is a multiple of 5, or to 15 minutes in this case. If secondary alarm switch 40 were pressed twice, the secondary alarm time period would be increased to 20 minutes. As the countdown begins within five seconds of the last depression of secondary alarm switch 40, the user preferably ensures that less than five seconds elapses between depressions of secondary alarm switch 40 when wishing to incrementally increase the secondary alarm time period.

After a predetermined amount of time (for example, a delay of ten seconds) has elapsed after an incremental increase of the secondary alarm time period by depression of secondary alarm switch 40, depression of secondary alarm switch 40 for a predetermined "reset" period of time (preferably, for example, approximately two seconds or greater) will preferably cause the selected secondary alarm time period to be canceled and the secondary alarm time period to be reset to zero. This reset feature allows the person sleeping to reset the secondary alarm time period if he or she has made a mistake or has a change of mind in selection of secondary alarm time period as well as to completely cancel the countdown or the secondary alarm time period (that is, to set the secondary alarm time period to zero). The ten-second delay feature discussed above assists in preventing accidental resetting of the secondary alarm time period during setting thereof.

Preferably, a single display window 90 is provided on alarm clock 10 as described above. In this embodiment, digital read out 94 is preferably toggled or alternated between different modes to display different types of information to the user. For example, in a first mode, with slide switch 86 set to real time, digital read out 94 displays the current time. Preferably, the time is displayed in a twelve-hour format and at least one indicator light 99 is provided to indicate PM or AM. In a second mode, with slide switch 86 set to the time set position, digital read out 94 displays the time as set using hour button 50 and minute button 60. In a third mode, with slide switch 86 set to the alarm set position, digital read out 94 displays the current primary alarm time setting which can be adjusted using hour button 50 and minute button 60.

A fourth mode is entered upon activation of secondary alarm switch 40 as described above. In this mode, digital read out 94 preferably toggles between displaying the current time and the amount of time remaining in the secondary alarm time period set by the user. Preferably, the digital read out toggles approximately every two seconds as controlled by central processing unit 120. Alternatively, a second display window (not shown) can be provided to indicate exclusively secondary alarm time period information.

When the secondary alarm time period remaining is less than one minute, the remaining secondary alarm time period may be displayed continuously in units of seconds and counts down to zero seconds at which time the alarm 150 will sound, indicating the selected secondary alarm time period has elapsed.

When alarm 150 sounds it preferably sounds for a specified period by turning on a radio signal or by emitting a sound such as a two kilohertz buzz as determined by switch 82. Sounding alarm 150, whether as a result of a primary alarm or a secondary alarm, preferably can be turned off manually by depressing secondary alarm switch 40 for a predetermined period of time (for example, approximately two seconds).

Unlike prior alarm clocks incorporating a snooze feature, the programming of the secondary alarm time period feature of the present invention may be activated at any time, regardless of whether the primary alarm has sounded or even whether the alarm switch is in the on or off position.

Alarm clock 10 is preferably operated at 3.0 volts using a DC adapter. A battery backup is preferably provided to continue operation of alarm clock 10 should AC power be discontinued for any reason. A battery low indicator 96 is preferably illuminated when the backup battery voltage falls below a lower limit such as 1.2 volts to let the user know that the backup battery or batteries should be changed.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. An alarm clock of the type being connectable to a power source, the alarm clock comprising:

a) a clock;

b) a display;

c) an alarm;

d) primary alarm circuitry in communication with the clock, the display and the alarm, the primary alarm circuitry including a primary alarm on/off switch and at least one input control for setting a primary alarm time corresponding to a predetermined time of day, the alarm being activated at the primary alarm time when the primary alarm on/off switch is in an on state;

e) a secondary alarm input control;

f) a central processing unit electrically connected to the display, the secondary alarm input control, the alarm and the clock; and g) a memory electrically connected to the central processing unit; the memory containing a program which enables a user to set the alarm to activate at the end of a countdown of a secondary alarm time period selected by the user via the secondary alarm input control; the program in the memory further providing that, upon a sounding of the alarm at the primary alarm time, activation of the secondary alarm input control stops sounding of the alarm and sets the secondary alarm time period to the secondary alarm time period selected by the user; the program in memory further providing that the secondary alarm period can also be set independent of whether the alarm has sounded at the primary alarm time or whether the primary alarm on/off switch is in an on or off state.

2. An alarm clock of claim 1 wherein the secondary alarm input control comprises a secondary alarm switch, the secondary alarm time period being selected by the user activating the secondary alarm switch for a first period of time a number of times, each activation of the secondary alarm switch for the first period of time increasing the secondary alarm time period by a predetermined interval of time; the program in the memory further providing that, upon a sounding of the alarm at the primary alarm time, activation of the secondary alarm switch for the first period of time stops sounding of the alarm and sets the secondary alarm time period to the predetermined interval of time, subsequent activations of the secondary alarm switch increasing the secondary alarm time period by the predetermined interval with each such activation; the program causing the secondary alarm time period to be displayed on the display unit.

3. The alarm clock of claim 2 wherein the program in the memory further provides that activation of the secondary alarm switch once for a second length of time after a secondary alarm time period has been set will reset secondary alarm time period to zero.

4. The alarm clock of claim 3 wherein the first period of time is less than two seconds and the second period of time is at least two seconds.

5. The alarm clock of claim 3 wherein the program in memory further provides for a time period following the last depression of the secondary alarm switch for the first period of time and preceding the depression of the secondary alarm switch for the second period of time during which depression of the secondary alarm switch will have no effect, so that the secondary alarm time period is not inadvertently reset to zero.

6. The alarm clock of claim 3 wherein the program in memory further provides that depression of the secondary alarm switch once for a third length of time after the alarm sounds at the primary alarm time or after the countdown of the secondary alarm time period will stop sounding of the alarm without the need to turn the alarm on/off switch to an off state and without setting the secondary alarm time period.

7. The alarm clock of claim 6 wherein the first period of time is less than two seconds and the second period of time and the third period of time are at least two seconds.

8. The alarm clock of claim 2 wherein the program in memory further provides that depression of the secondary alarm switch once for a second length of time after the alarm sounds at the primary alarm time or after the countdown of the secondary alarm time period will stop sounding of the alarm without the need to turn the alarm on/off switch to an off state and without setting the secondary alarm time period.

9. The alarm clock of claim 6 wherein the program in the memory further provides that a time remaining in the secondary alarm time period can be increased by activation of the secondary alarm switch for the first period of time one or more times at any time during a countdown of the secondary alarm time.

10. The alarm clock of claim 2 wherein the program in the memory further provides that a time remaining in the secondary alarm time period can be increased by activation of the secondary alarm switch for the first period of time one or more times at any time during a countdown of the secondary alarm time.

11. The alarm clock of claim 9 wherein the alarm clock further comprises a housing, the display being attached to the housing, the clock, the alarm, the memory, and the central processing unit being enclosed within the housing, the secondary alarm switch being attached to the housing in a manner to make it easily locatable by a user of the alarm clock.

12. The alarm clock of claim 10, wherein the housing has at least two surfaces, the secondary alarm switch being the only switch attached to one of the surfaces.

13. The alarm clock of claim 2 wherein after a secondary alarm period has been set, the display alternates between displaying the time of day and the time remaining in the secondary alarm period.

14. The alarm clock of claim 12 wherein after a secondary alarm period has been set, the display alternates between displaying the time of day and the time remaining in the secondary alarm period.

15. An alarm clock of the type being connectable to a power source, the alarm clock comprising:

a) a clock;

b) a display;

c) an alarm;

d) a primary alarm on/off switch, the alarm being activated at the primary alarm time when the primary alarm on/off switch is in an on state; and e) at least one input control for setting a primary alarm time corresponding to a predetermined time of day;

f) an alarm discontinue switch, the alarm discontinue switch being operable to discontinue activation of the alarm after the primary alarm time without changing the state of the primary alarm on/off switch to an off state.

16. The alarm clock of claim 15 wherein the alarm discontinue switch includes circuitry to prevent accidental discontinuance of activation of the alarm.

17. The alarm clock of claim 16 wherein the alarm discontinue switch is a button-type switch that must be pressed and held for a predefined period of time to discontinue activation of the alarm.

* * * * *